US011810510B2

(12) United States Patent
Choi

(10) Patent No.: US 11,810,510 B2
(45) Date of Patent: Nov. 7, 2023

(54) DISPLAY DEVICE WITH HARDWARE THAT DIMS PIXELS

(71) Applicant: Google LLC, Mountain View, CA (US)

(72) Inventor: Sangmoo Choi, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/920,453

(22) PCT Filed: Dec. 2, 2021

(86) PCT No.: PCT/US2021/061568
§ 371 (c)(1),
(2) Date: Oct. 21, 2022

(87) PCT Pub. No.: WO2023/101674
PCT Pub. Date: Jun. 8, 2023

(65) Prior Publication Data

US 2023/0298521 A1 Sep. 21, 2023

(51) Int. Cl.
*G09G 3/3258* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/0232* (2013.01); *G09G 2310/08* (2013.01); *G09G 2320/0686* (2013.01)

(58) Field of Classification Search
CPC ..... G09G 3/3233; G09G 3/3258; G09G 2310/0232; G09G 2320/0686
See application file for complete search history.

(56) References Cited

U.S. PATENT DOCUMENTS

| | | | | |
|---|---|---|---|---|
| 7,557,784 | B2 | 7/2009 | Kwak et al. | |
| 10,198,979 | B2 | 2/2019 | Chaji et al. | |
| 10,395,578 | B2 | 8/2019 | Lee et al. | |
| 10,409,118 | B1 | 9/2019 | Chang et al. | |
| 10,971,071 | B2 | 4/2021 | Shim | |
| 2016/0125808 | A1* | 5/2016 | Hsu | G09G 3/3233 345/212 |
| 2017/0270860 | A1* | 9/2017 | Wang | G09G 3/3258 |

(Continued)

OTHER PUBLICATIONS

International Search Report and Written Opinion in International Appln. No. PCT/US2021/061568, dated Jul. 7, 2022, 15 pages.

*Primary Examiner* — Dennis P Joseph
(74) *Attorney, Agent, or Firm* — Fish & Richardson P.C.

(57) ABSTRACT

An electronic device includes a display device that includes a plurality of pixels that form an active area of the display device, the active area of the display device defining a rounded edge portion, wherein multiple pixels that form at least part of the rounded edge portion have stepped relative brightness levels determined by hardware structures of the multiple pixels, such that a first pixel of the multiple pixels that is located at a first position in the rounded edge portion has a first relative brightness level defined by a first pixel hardware structure and a second pixel of the multiple pixels that is located at a second position has a second relative brightness level defined by a second pixel hardware structure, the first relative brightness level being different from the second relative brightness level, the first pixel hardware structure being different from the second pixel hardware structure.

17 Claims, 8 Drawing Sheets

(56) References Cited

U.S. PATENT DOCUMENTS

| | | | | |
|---|---|---|---|---|
| 2017/0337878 | A1* | 11/2017 | Kim | H01L 27/1214 |
| 2018/0246363 | A1 | 8/2018 | Nemati et al. | |
| 2020/0082763 | A1* | 3/2020 | Kim | G09G 3/3266 |
| 2020/0194594 | A1 | 6/2020 | Ko et al. | |
| 2022/0344425 | A1* | 10/2022 | Zhu | H10K 59/1216 |
| 2023/0162680 | A1* | 5/2023 | Choi | G09G 3/3258 345/214 |

* cited by examiner

800

| Configuration | W/L Ratio | VBIAS | Resistance | IOLED2 | IOLED1 | Brightness |
|---|---|---|---|---|---|---|
| 801 | ← | ↕ | → | ← | → | → |
| 802 | → | ↕ | ← | → | ← | ← |
| 803 | ↕ | ← | ← | → | ← | ← |
| 804 | ↕ | → | → | ← | → | → |

FIG. 8

DISPLAY DEVICE WITH HARDWARE THAT DIMS PIXELS

CROSS-REFERENCE TO RELATED APPLICATION

This application is a National Stage Application under 35 U.S.C. § 371 and claims the benefit of International Application No. PCT/US2021/061568, filed Dec. 2, 2021, the disclosure of which is hereby incorporated by reference in its entirety.

TECHNICAL FIELD

This specification relates generally to electronic devices having a display panel.

BACKGROUND

Electronic devices may include display panels on which visual images may be shown. For example, a user of an electronic device may view visual images on a flat panel display while watching a video or playing a video game. Many electronic devices are equipped with large displays covering most of the front face of the device. Electronic devices may include a bezel surrounding the active area of the display. The active area of the display can have rounded corners such that a boundary between the active area and the bezel is rounded.

SUMMARY

Techniques are disclosed for dimming pixels, for example, of rounded display corners. An electronic device may include a display panel that includes a pixel array of light emitting pixels. The array of light emitting pixels can include an active area defined by an outline. In some examples, the outline has rounded corners. Electronic devices can include interior windows, e.g., for sensors located under the display.

For displays having rounded corners, interior windows, or both, the pixels in outer edges of the curved boundaries can be partially dimmed to approximate smooth curves using the square or rectangular pixels. The pixel circuits of the dimmed pixels include diode-connected transistors that are connected to the anode electrode of the respective pixel OLEDs to route a portion of current away from the OLEDs to achieve the dimming.

Dimming levels of pixels can be controlled at design by adjusting aspect ratios of the diode-connected transistors, and during runtime by adjusting bias voltages (VBIAS) of the diode-connected transistors, or both. In some examples, the aspect ratio and/or VBIAS of the diode-connected transistor can vary for subpixels of a pixel. In some examples, VBIAS of the diode-connected transistor can vary for different display brightness settings.

As additional description to the embodiments described below, the present disclosure describes the following embodiments.

Embodiment 1 is directed to an electronic device, comprising: a display device that includes a plurality of pixels that form an active area of the display device, the active area of the display device defining a rounded edge portion, wherein multiple pixels that form at least part of the rounded edge portion have stepped relative brightness levels that are determined by hardware structures of the multiple pixels, such that a first pixel of the multiple pixels that is located at a first position in the rounded edge portion has a first relative brightness level defined by a first pixel hardware structure and a second pixel of the multiple pixels that is located at a second position in the rounded edge portion has a second relative brightness level defined by a second pixel hardware structure, the first relative brightness level being different from the second relative brightness level, the first pixel hardware structure being different from the second pixel hardware structure.

Embodiment 2 is the electronic device of embodiment 1, wherein the first pixel is adjacent the second pixel in the display device.

Embodiment 3 is the electronic device of any one of the embodiments 1 through 2, wherein: the first relative brightness level comprises a first default dimmed brightness level that is dimmed with respect to a first programmed brightness level that is programmed to the first pixel; and the second relative brightness level comprises a second default dimmed brightness level that is dimmed with respect to a second programmed brightness level that is programmed to the second pixel.

Embodiment 4 is the electronic device of embodiment 3, wherein: the display device includes central pixels that form a central region of the display device that is offset from the rounded edge portion; and each central pixel of the central pixels that form the central region of the display device is structured to emit a brightness level programmed to the respective central pixel.

Embodiment 5 is the electronic device of embodiment 4, wherein: the central pixels form a contiguous block of at least one-hundred pixels offset from the rounded edge portion.

Embodiment 6 is the electronic device of any one of the embodiments 1 through 5, wherein: the first pixel comprises a first organic light-emitting diode (OLED); and the second pixel comprises a second OLED.

Embodiment 7 is the electronic device of any one of the embodiments 1 through 6, wherein: the first pixel includes: a first light-emitting diode (LED), a first resistive element, and a first driving transistor configured to drive current in parallel through the first LED and the first resistive element during emission of light by the first LED; and the second pixel includes: a second LED, a second resistive element, and a second driving transistor configured to drive current in parallel through the second LED and the second resistive element during emission of light by the second LED.

Embodiment 8 is the electronic device of embodiment 7, wherein: the first resistive element has a first resistance being in a first proportion to a resistance of the first LED; the second resistive element has a second resistance being in a second proportion to a resistance of the second LED; and the first proportion is different from the second proportion.

Embodiment 9 is the electronic device of any one of the embodiments 7 through 8, wherein: the display device includes central pixels that form a central region of the display device that is offset from the rounded edge portion; and each central pixel of the central pixels that form the central region of the display device includes a corresponding central pixel LED and corresponding central pixel driving transistor that is configured to drive current through the corresponding central pixel LED without driving current through a corresponding resistive element in parallel with the corresponding central pixel LED.

Embodiment 10 is the electronic device of any one of the embodiments 7 through 9, wherein: the first resistive element comprises a first diode-connected transistor that includes a first diode-connected transistor gate terminal and a first diode-connected transistor drain terminal that is connected to the first diode-connected transistor gate terminal; and the second resistive element comprises a second diode-connected transistor that includes a second diode-connected transistor gate terminal and a second diode-connected transistor drain terminal that is connected to the second diode-connected transistor gate terminal.

Embodiment 11 is the electronic device of embodiment 10, wherein: the first diode-connected transistor has a first resistance being in a first proportion to a resistance of the first LED; the second diode-connected transistor has a second resistance being in a second proportion to a resistance of the second LED; and the first proportion is different from the second proportion.

Embodiment 12 is the electronic device of embodiment 11, wherein: the first diode-connected transistor has the first resistance due to the first diode-connected transistor having a first aspect ratio of physical dimensions; and the second diode-connected transistor has the second resistance due to the second diode-connected transistor having a second aspect ratio of physical dimensions; and the first aspect ratio is different from the second aspect ratio.

Embodiment 13 is the electronic device of any one of the embodiments 10 through 12, wherein: the first pixel is a sub-pixel of a first composite pixel in the display device; the second pixel is a sub-pixel of a second composite pixel in the display device; and the first LED of the first pixel emits a same color as the second LED of the second pixel, such that the first pixel and the second pixel represent same-colored subpixels.

Embodiment 14 is the electronic device of embodiment 13, wherein: the first diode-connected transistor drain terminal is connected to a first bias voltage; and the second diode-connected transistor drain terminal is connected to the first bias voltage.

Embodiment 15 is the electronic device of embodiment 14, wherein: the display device is configured so that increasing the first bias voltage increases a first resistance of the first diode-connected transistor and increases a second resistance of the second diode-connected transistor.

Embodiment 16 is the electronic device of any one of the embodiments 14 through 15, wherein: the display device includes: a third pixel that includes: a third LED, a third resistive element that comprises a third diode-connected transistor that includes a third diode-connected transistor gate terminal and a third diode-connected transistor drain terminal that is connected to the third diode-connected transistor gate terminal, and a third driving transistor configured to drive current in parallel through the third LED and the third diode-connected transistor during emission of light by the third LED; and a fourth pixel that includes: a fourth LED, a fourth resistive element that comprises a fourth diode-connected transistor that includes a fourth diode-connected transistor gate terminal and a fourth diode-connected transistor drain terminal that is connected to the fourth diode-connected transistor gate terminal, and a fourth driving transistor configured to drive current in parallel through the fourth LED and the fourth diode-connected transistor during emission of light by the fourth LED; the third pixel is a sub-pixel of the first composite pixel; the fourth pixel is a sub-pixel of the second composite pixel; the third LED of the third pixel emits a same color as the fourth LED of the fourth pixel, such that the third pixel and the fourth pixel represent same-colored subpixels; and the color emitted by the first pixel and the second pixel is different from the color emitted by the third pixel and the fourth pixel.

Embodiment 17 is the electronic device of embodiment 16, wherein: the third diode-connected transistor drain terminal is connected to a second bias voltage; the fourth diode-connected transistor drain terminal is connected to the second bias voltage; and the second bias voltage is different from the first bias voltage.

Embodiment 18 is the electronic device of embodiment 7, wherein: the first driving transistor is connected to the first LED via a first intermediate transistor in series between the first driving transistor and the first LED; and the second driving transistor is connected to the second LED via a second intermediate transistor in series between the second driving transistor and the second LED.

Embodiment 19 is directed to a display device that includes multiple light emitting diodes (LEDs), comprising: a first LED of the multiple LEDs, the first LED including a first LED anode terminal and a first LED cathode terminal; a first driving transistor that includes a first driving transistor source terminal, a first driving transistor gate terminal, and a first driving transistor drain terminal, the first driving transistor drain terminal connected to the first LED anode terminal; a first resistive element that is connected to the first driving transistor drain terminal, the display device configured so that current flows through the first LED and the first resistive element during emission of the first LED; a second LED of the multiple LEDs, the second LED including a second LED anode terminal and a second LED cathode terminal; a second driving transistor that includes a second driving transistor source terminal, a second driving transistor gate terminal, and a second driving transistor drain terminal, the second driving transistor drain terminal connected to the second LED anode terminal; and a second resistive element that is connected to the second driving transistor drain terminal, the display device configured so that current flows through the second LED and the second resistive element during emission of the second LED.

Embodiment 20 is the display device of embodiment 19, wherein: the first resistive element has a first resistance being in a first proportion to a resistance of the first LED; the second resistive element has a second resistance being in a second proportion to a resistance of the second LED; and the first proportion is different from the second proportion.

Embodiment 21 is the display device of embodiment 20, wherein: the multiple LEDs form an array of pixels; the first LED is at least part of a first pixel that is part of an edge of an active display area of the array of pixels; the second LED is at least part of a second pixel that is part of the edge of the active display area of the array of pixels; and the first pixel is adjacent the second pixel.

Embodiment 22 is the display device of embodiment 21, comprising: a collection of third LEDs of the multiple LEDs, each respective third LED in the collection of third LEDs including a third LED anode terminal and a third LED cathode terminal; and a collection of third driving transistors that correspond to the collection of third LEDs, each respective third driving transistor in the collection of third driving transistors including a third driving transistor source terminal, a third driving transistor gate terminal, and a third driving transistor drain terminal, wherein: the third driving transistor drain terminal of each respective third driving transistor is connected to the third LED anode terminal of a corresponding third LED from the collection of third LEDs, the third driving transistor drain terminal of each respective third driving transistor is without a connection to a source terminal of a resistive element through which current would flow during emission of the corresponding third LED.

Embodiment 23 is the display device of embodiment 22, wherein: the display device being configured so that: (i) current flows through the first resistive element during emission of the first LED; (ii) current flows through the second resistive element during emission of the second LED; and (iii) each respective third driving transistor is without a connection to a source terminal of a resistive element through which current would flow during emission of the corresponding third LED, results in: (i) the first LED emitting at a first default dimmed level with respect to the collection of third LEDs; and (ii) the second LED emitting at a second default dimmed level with respect to the collection of third LEDs.

Embodiment 24 is the display device of embodiment 22, wherein: the collection of third LEDs form a contiguous block of at least one-hundred pixels offset from the edge of the active display area of the array of pixels.

Embodiment 25 is the display device of embodiment 24, wherein: the edge of the active display area of the array of pixels is a rounded edge of the active display area of the array of pixels.

Embodiment 26 is the display device of any one of the embodiments 19 to 25, wherein: the first LED is an Organic LED (OLED); and the second LED is an OLED.

Embodiment 27 is the display device of any one of the embodiments 19 to 26, wherein: the first resistive element comprises a first diode-connected transistor that includes a first diode-connected transistor source terminal, a first diode-connected transistor gate terminal, and a first diode-connected transistor drain terminal; the first diode-connected transistor gate terminal is connected to the first diode-connected transistor drain terminal; the second resistive element comprises a second diode-connected transistor that includes a second diode-connected transistor source terminal, a second diode-connected transistor gate terminal, and a second diode-connected transistor drain terminal; and the second diode-connected transistor gate terminal is connected to the second diode-connected transistor drain terminal.

Embodiment 28 is the display device of embodiment 27, wherein: the first diode-connected transistor has a first resistance being in a first proportion to a resistance of the first LED; the second diode-connected transistor has a second resistance being in a second proportion to a resistance of the second LED; and the first proportion is different from the second proportion.

Embodiment 29 is the display device of embodiment 28, wherein: the first diode-connected transistor has the first resistance due to the first diode-connected transistor having a first aspect ratio of physical dimensions; and the second diode-connected transistor has the second resistance due to the second diode-connected transistor having a second aspect ratio of physical dimensions; and the first aspect ratio is different from the second aspect ratio.

Embodiment 30 is the display device of embodiment 28, wherein: the first LED is a sub-pixel of a first pixel in an array of pixels; the second LED is a sub-pixel of a second pixel in the array of pixels; and the first LED emits a same color as the second LED, such that the first LED and the second LED represent same-colored subpixels.

Embodiment 31 is the display device of embodiment 30, wherein: the first diode-connected transistor drain terminal is connected to a first bias voltage; and the second diode-connected transistor drain terminal is connected to the first bias voltage.

Embodiment 32 is the display device of embodiment 31, wherein: the display device is configured so that increasing the first bias voltage increases the first resistance of the first diode-connected transistor and increases the second resistance of the second diode-connected transistor.

Embodiment 33 is the display device of embodiment 31, comprising: a third LED of the multiple LEDs, the third LED including a third LED anode terminal and a third LED cathode terminal; a third driving transistor that includes a third driving transistor source terminal, a third driving transistor gate terminal, and a third driving transistor drain terminal, the third driving transistor drain terminal connected to the third LED anode terminal; a third resistive element that is connected to the third driving transistor drain terminal, the display device configured so that current flows through the third LED and the third resistive element during emission of the third LED; a fourth LED of the multiple LEDs, the fourth LED including a fourth LED anode terminal and a fourth LED cathode terminal; a fourth driving transistor that includes a fourth driving transistor source terminal, a fourth driving transistor gate terminal, and a fourth driving transistor drain terminal, the fourth driving transistor drain terminal connected to the fourth LED anode terminal; and a fourth resistive element that is connected to the fourth driving transistor drain terminal, the display device configured so that current flows through the fourth LED and the fourth resistive element during emission of the fourth LED, wherein: the third LED is a sub-pixel of the first pixel in an array of pixels; the fourth LED is a sub-pixel of the second pixel in the array of pixels; the third LED emits a same color as the fourth LED, such that the first LED and the second LED represent same-colored subpixels; and the color emitted by the first LED and the second LED is different from the color emitted by the third LED and the fourth LED.

Embodiment 34 is the display device of embodiment 33, wherein: the third diode-connected transistor drain terminal is connected to a second bias voltage; the fourth diode-connected transistor drain terminal is connected to the second bias voltage; and the second bias voltage is different from the first bias voltage.

Embodiment 35 is the display device of any one of the embodiments 19 to 34, wherein: the first driving transistor drain terminal is connected to the first LED anode terminal via a source terminal and a drain terminal, respectively, of a first intermediate transistor; and the second driving transistor drain terminal is connected to the second LED anode terminal via source terminal and a drain terminal, respectively, of a second intermediate transistor.

Embodiment 36 is a display device that includes multiple light emitting diodes (LEDs) forming an array of pixels, comprising: a first LED of the multiple LEDs, the first LED including a first LED anode terminal and a first LED cathode terminal, wherein the first LED is at least part of a first pixel that is part of an edge of an active display area of the array of pixels; a first driving transistor that includes a first driving transistor source terminal, a first driving transistor gate terminal, and a first driving transistor drain terminal, the first driving transistor drain terminal connected to the first LED anode terminal; a first diode-connected transistor that is connected to the first driving transistor drain terminal, the display device configured so that current flows through the first LED and the first diode-connected transistor during emission of the first LED; a second LED of the multiple LEDs, the second LED including a second LED anode terminal and a second LED cathode terminal, wherein the second LED is at least part of a second pixel that is at the edge of the active display area of the array of pixels; a second driving transistor that includes a second driving transistor source terminal, a second driving transistor gate terminal, and a second driving transistor drain terminal, the second driving transistor drain terminal connected to the second LED anode terminal; and a second diode-connected transistor that is connected to the second driving transistor drain terminal, the display device configured so that current flows through the second LED and the second diode-connected transistor during emission of the second LED.

Embodiment 37 is the display device of embodiment 36, wherein: the first diode-connected transistor has a first resistance being in a first proportion to a resistance of the first LED; the second diode-connected transistor has a second resistance being in a second proportion to a resistance of the second LED; the first proportion is different from the second proportion; a drain terminal of the first diode-connected transistor is connected to a first bias voltage; and a drain terminal of the second diode-connected transistor is connected to the first bias voltage, wherein: the display device is configured so that increasing the first bias voltage increases a first resistance of the first diode-connected transistor and increases a second resistance of the second diode-connected transistor.

Embodiment 38 is the display device of any one of the embodiments 36 or 37, comprising: a collection of third LEDs of the multiple LEDs, each respective third LED in the collection of third LEDs including a third LED anode terminal and a third LED cathode terminal; and a collection of third driving transistors that correspond to the collection of third LEDs, each respective third driving transistor in the collection of third driving transistors including a third driving transistor source terminal, a third driving transistor gate terminal, and a third driving transistor drain terminal, wherein: the third driving transistor drain terminal of each respective third driving transistor is connected to the third LED anode terminal of a corresponding third LED from the collection of third LEDs, the third driving transistor drain terminal of each respective third driving transistor being without a connection to a source terminal of a diode-connected transistor through which current would flow during emission of the corresponding third LED.

The disclosed techniques can be used to improve the smoothness of rounded display corners of active display areas by dimming pixels located at or near the corners. The disclosed techniques can reduce power consumption in display SoCs and DDICs compared to other techniques for dimming pixels. The disclosed techniques can also improve the smooth appearance of rounded corners.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

FIG. 8 is a table showing relationships between pixel brightness and changes in bias voltage and transistor width-to-length ratios.

Like reference numbers and designations in the various drawings indicate like elements.

DETAILED DESCRIPTION

Figure 1:
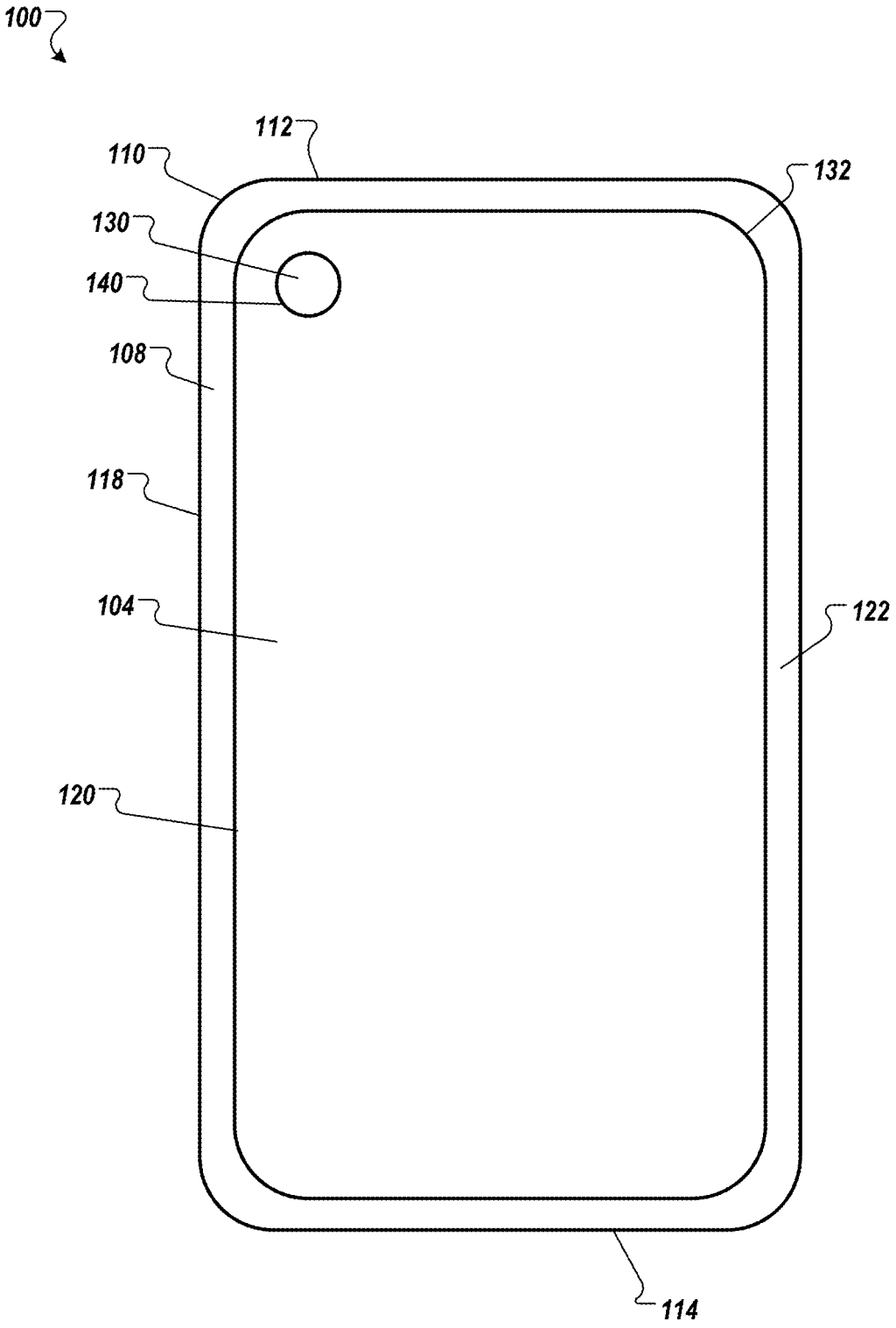
FIG. 1 is a diagram of an example electronic device with a display panel and a bezel.

FIG. 1 is a diagram of an example display panel 100 with a display active area 104 and a bezel 108. The display panel 100 may be assembled in electronic devices, for example, a smart phone, a television, a smart watch, or a handheld game console. The display panel 100 includes an array of multiple light emitting pixels. The display panel 100 may be, for example, an active matrix organic light emitting diode (OLED) panel, or a light emitting diode (LED) liquid crystal displays (LCD) panel. The display panel 100 may be housed in a chassis. The chassis may be referred to as a housing.

The display panel 100 includes a top edge 112, right and left side edges 118, and a bottom edge 114. The display panel 100 includes a bezel 108. The bezel 108 is the area between the edge of the display panel 100 and the edge of the display active area 104. The bezel 108 surrounds the array of light emitting pixels of the display panel 100. The bezel 108 can include the driver circuits for the display panel 100, the power supply lines, and the signal lines between the display control circuits and the integrated driver circuits or pixels. The active area 104 is bounded by outline 120. The outline 120 separates the active area 104 from the bezel 122.

The display panel 100 includes a sensor window, e.g., the display panel 100 defines a camera window 130. The camera window 130 is an area of the display panel 100 that corresponds to a location of a sensor in the electronic device. The sensor can be, for example, a camera. The camera window 130 is an area of the display panel 100 in which the pixels are not active. The camera window 130 is bounded by camera outline 140. The camera outline 140 separates the camera window 130 from the active area 104. The camera outline 140 can be referred to as an interior edge of the active area 104.

The light intensity of a pixel may be determined by a grayscale value. Pixel light intensities can be represented as grayscale values that include integers from zero to 255, representing an example 8-bit grayscale display. Other grayscale value ranges can be used. For example, grayscale values may range from zero to 1023 for a 10-bit display, or from zero to 65535 for a 16-bit display. Other possible grayscale value ranges may include a range from zero to one, with fractional values in between, and a range from zero percent (%) to 100%.

For a full color display that spatially synthesizes color, each pixel may include multiple color channels, or subpixels. In some examples, each pixel may include each of a red, green, and blue subpixel. In some examples, each pixel may include each of a cyan, magenta, and yellow subpixel. The light intensities of each subpixel may be represented with grayscale values as described above, e.g., integers from zero to 255 for an 8-bit display.

Figure 2:
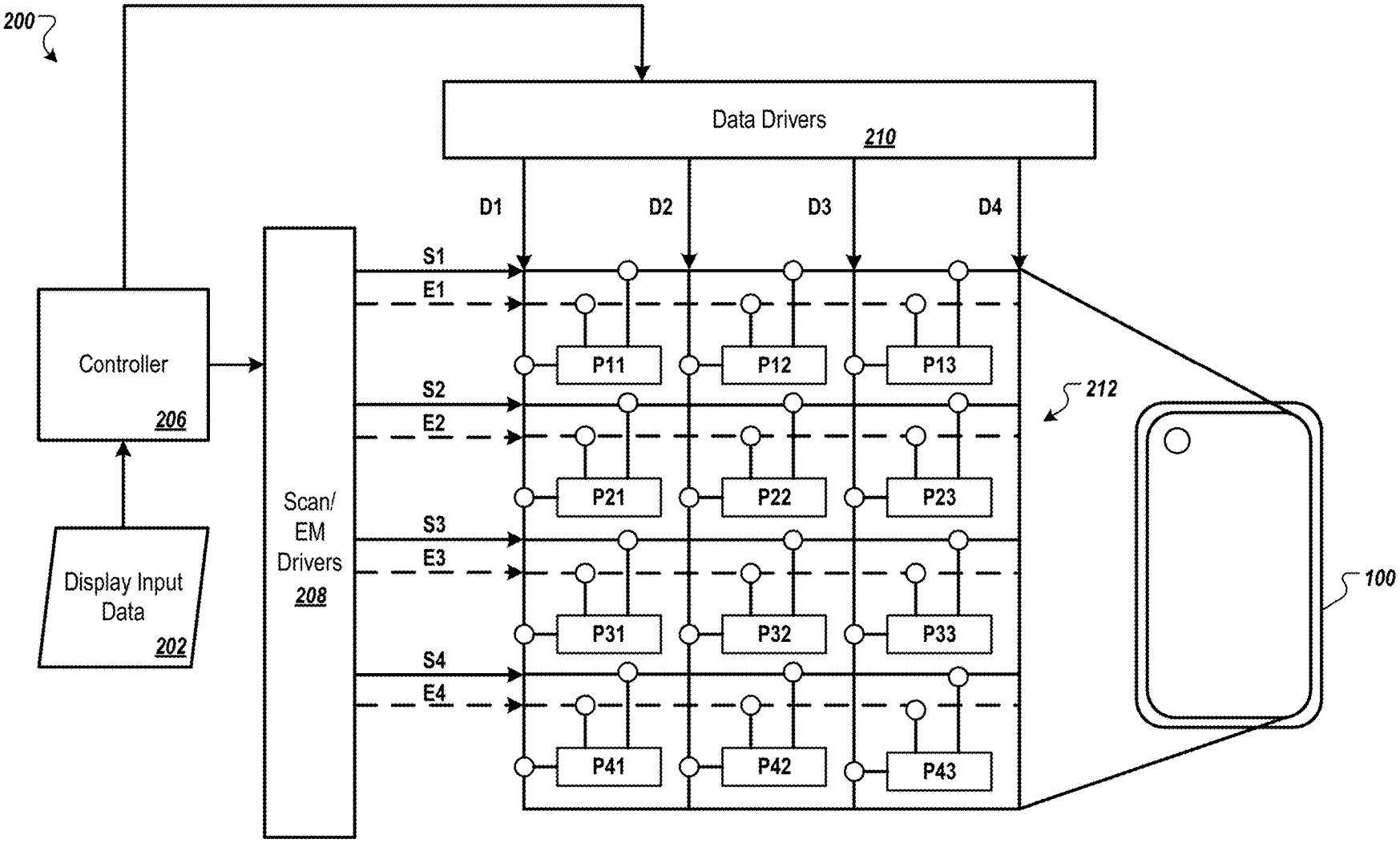
FIG. 2 is a diagram of a display system of an electronic device.

FIG. 2 is a diagram of an example display system 200 of a display panel. For example, FIG. 2 may illustrate the display system 200 of the display panel 100. The display system 200 is an OLED display system that includes an array 212 of light emitting pixels. Each light emitting pixel includes an OLED. The OLED display is driven by drivers including scan/emission drivers 208 and data drivers 210. In general, the scan/emission drivers 208 selects a row of pixels in the display, and the data drivers 210 provide data signals (e.g. voltage data) to the pixels in the selected row to light the selected OLEDs according to the image data. Signal lines such as scan lines, emission lines, and data lines may be used in controlling the pixels to display images on the display. Though FIG. 2 illustrates the display system 200 having the scan/emission drivers 208 on one side, the scan/emission drivers 208 can be placed on both left and right sides of the display improving the driving performance (e.g. speed).

The display system 200 includes the pixel array 212 that includes a plurality of light emitting pixels, e.g., the pixels P11 through P43. A pixel is a small element on a display that can change color based on the image data supplied to the pixel. Each pixel within the pixel array 212 can be addressed separately to produce various intensities of color. The pixel array 212 extends in a plane and includes rows and columns. A row extends horizontally across the array. For example, the first row of the pixel array 212 includes pixels P11, P12, and P13. A column extends vertically down the display. For example, the first column of the pixel array 212 includes pixels P11, P21, P31, and P41. Only a fey pixels are shown in FIG. 2 for simplicity. In practice, there may be several million pixels in the pixel array 212. Greater numbers of pixels can result in higher image resolution.

The display system 200 includes scan/emission drivers 208 and data drivers 210. The scan/emission drivers 208 are integrated, i.e., stacked, row line drivers that supply signals to rows of the pixel array 212. For example, the scan/emission drivers 208 supply scan signals S1 to S4, and emission signals E1 to E4, to the rows of pixels. The data drivers 210 supply signals to columns of the pixel array 212. For example, the data drivers 210 supply data signals D1 to D4 to the columns of pixels.

Each pixel in the pixel array 212 is addressable by a horizontal scan line and emission line, and a vertical data line. For example, the pixel P11 is addressable by the scan line S1, the emission line E1, and the data line D1. In another example, the pixel P32 is addressable by the scan line S3, the emission line E3, and the data line D2.

The display system 200 includes a controller 206 that receives display input data 202. The controller 206 may include a graphic controller and a timing controller. The controller generates the timing of the signals for delivery to the display. The controller 206 provides the input signals (e.g. clock signals, start pulses) to the scan/emission drivers 208, and the image data to the data drivers 210.

The scan/emission drivers 208 and the data drivers 210 provide signals to the pixels enabling the pixels to reproduce the image on the display. The scan/emission drivers 208 and the data drivers 210 provide the signals to the pixels via the scan lines, the emission lines, and the data lines. To provide the signals to the pixels, the scan/emission drivers 208 select a scan line and control the emission operation of the pixels. The data drivers 210 provides data signals to the pixels addressable by the selected scan line to light the selected OLEDs according to the image data.

Although FIG. 2 illustrates an OLED display, the technique for reducing display corner bezel size may be applied to any flat panel display that includes an array of pixels. For example, the technique for reducing display corner bezel size may be applied to light emitting diode (LED) liquid crystal displays (LCD) and plasma display panels (PDP).

Figures 3A, 3B:
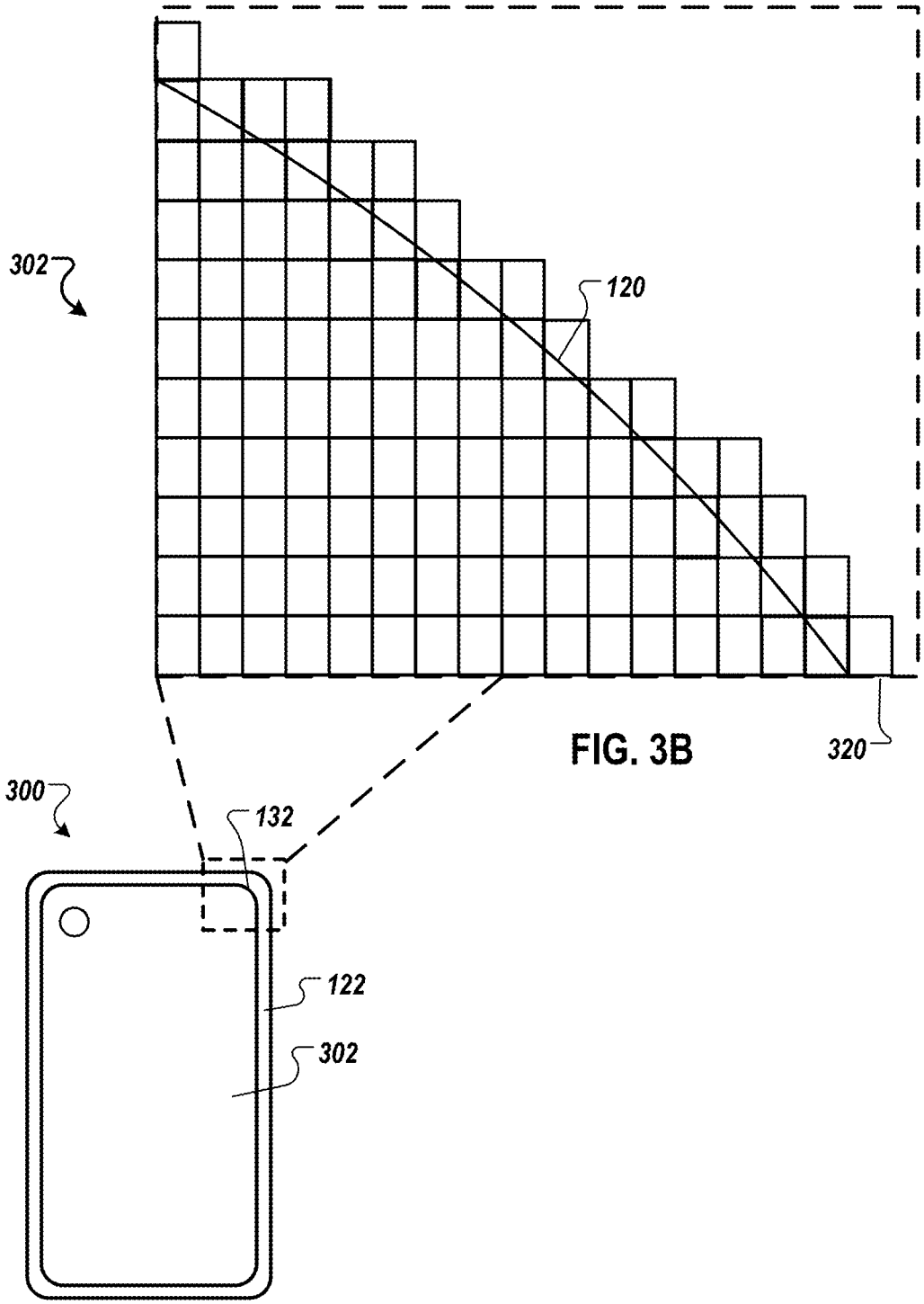
FIGS. 3A and 3B illustrate an example of pixels of a rounded display corner.

FIGS. 3A and 3B illustrate an example of pixels of a rounded display corner. FIG. 3A illustrates a display panel 300 with a display system that dims pixels of rounded display corners. The display panel 300 includes a pixel array 302. FIG. 3B illustrates a detailed view of the top right corner 132 of the display panel 300, including the top right portion of the pixel array 302.

Although FIG. 3A and FIG. 3B illustrate the top right corner of the display panel 300, the technique for reducing display corner bezel size can also be applied to other corner regions of the display panel 300, e.g., the top left corner. FIG. 3B shows the upper right portion 320 of the pixel array 302 at the top corner of the display panel 300.

Pixels often have a square or rectangular shape. Thus, when displays have rounded outlines, the shape of the outline of the active area is not exactly rounded. Rather, the outline has a jagged shape similar to a staircase. This causes non-smooth rounded edges in the display screen. To achieve a perceived smoother rounded shape, individual pixel luminance at the rounded edges is gradually decreases depending on the amount of the pixel that overlaps the active area.

The outline 120 is a target outline that traces a smooth curve. The disclosed techniques can be used to illuminate pixels to approximately the outline 120 using square or rectangular pixels. The outline 120 is approximately by gradually dimming pixels that are at or near the outline 120.

Figure 4:
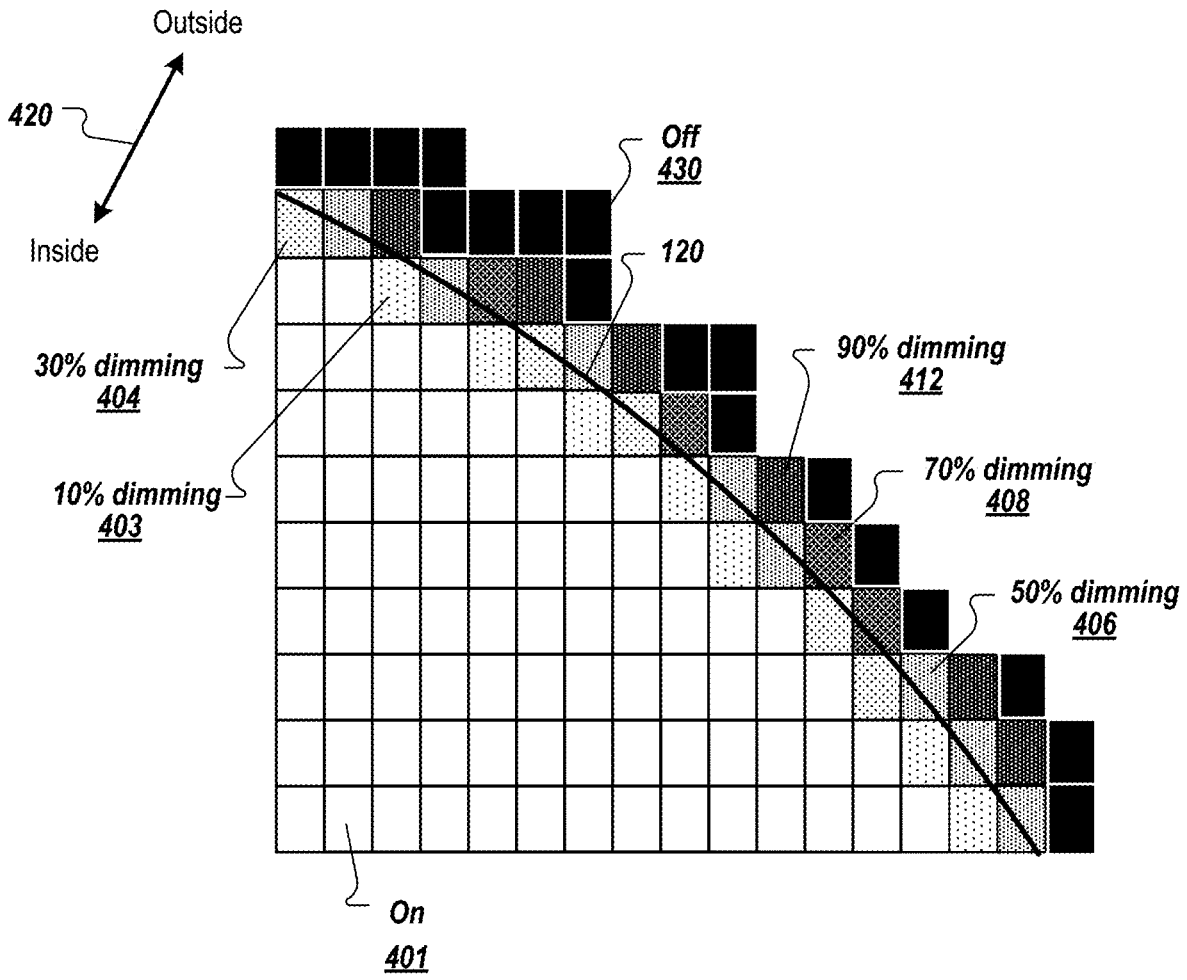
FIG. 4 illustrates an example of dimming pixels of rounded display corners.

Pixels can be gradually dimmed from inside the outline 120 to outside of the outline 120. Referring to FIG. 4, the directions of "inside" and "outside" are represented by arrow 420. Generally, "inside" refers to a direction away from the outline 120 and towards the full brightness pixels of the active area. "Outside" refers to a direction away from the outline 120 and towards an edge of the display panel, e.g., edges 118. Though FIG. 4 shows an example display corner, e.g., corner 132, the pixel dimming techniques described with reference to FIG. 4 can also be applied to interior windows of a display, e.g., camera window 130. Thus, the disclosed techniques can be applied to both exterior edges and interior edges of the active area of a display.

In some examples, pixels entirely within the outline are full brightness, pixels entirely outside the outline are fully dim, and pixels that are along the outline are fractionally dimmed in a gradual pattern. The pixels illustrated in FIG. 4 are dimmed to various dimming levels, with each such pixel dimmed using a current divider in a corresponding pixel circuit that reduces an amount of current flowing through the OLED. The current divider includes a resistive element such as a diode-connected transistor. The current divider is described in greater detail with reference to FIG. 6.

In some examples, not all of the pixels of the display include the current divider. For example, pixels that are not at or near a rounded edge might not include the current divider. Referring to FIG. 4, pixel 401 is located inside of the outline 120 and away from the edge. In some examples, the pixel 401 is one of a collection of pixels that does not include a current divider having a diode-connected transistor. In some examples, the pixel 401 is part of a contiguous block of at least one-hundred pixels offset from the edge of the pixel array 302. When pixel 401 is "on," e.g., emitting light, pixel 401 is not dimmed, due to not including the current divider. Therefore pixel 401 can be referred to as a full brightness pixel (despite the ability of a computing device with the display in FIG. 4 being able to dim pixel 401 by changing a duty cycle at which pixel 401 emits light and/or an amount of current provided towards pixel 401 by a pixel driving transistor).

Similarly, pixel 430 is located outside of the outline 120 and away from the edge. In some embodiments, the pixel 430 does not include the current divider. When pixel 430 is "on," e.g., emitting light, pixel 430 is not dimmed, due to not including the current divider. Therefore pixel 430 can be referred to as a full brightness pixel. However, due to being located outside of the outline 120, pixel 430 will generally be "off," e.g., not emitting light. Pixel 430 may not be considered part of an active display area of a display, because it is generally "off" during normal operation of the display device. In some implementations, a display device may be constructed with a design similar to that in FIG. 4, except that the display would not include pixels that are "outside" the ideal outline 120.

The edge of the pixel array 302 is a rounded edge defined by the outline 120. In the example of FIG. 4, the pixels 403, 404, 406, 408, and 412 are located at or near the edge defined by the outline 120 (e.g., the ideal outline passes through the pixel). The pixel circuits of pixels 403, 404, 406, 408, and 412 each include a current divider including a diode-connected transistor. Differences in the physical properties of the diode-connected resistors result in different dimming levels of the pixels 403, 404, 406, 408, and 412 compared to each other.

The pixels 403, 404, 406, 408, 412, exhibit gradual dimming from inside towards outside. The pixel 406 is approximately evenly split between being inside the outline 120 and outside the outline 120, and is 50% dimmed. The pixels 403, 404 are mostly inside the outline 120, and are 10% dimmed and 30% dimmed, respectively. The pixels 408 and 412 are mostly outside the outline 120 and are 70% dimmed and 90% dimmed, respectively.

Although shown in FIG. 4 as having five dimming levels (e.g., 10%, 30%, 50%, 70%, 100%), other dimming levels are possible. For example, the pixel array 302 can have any appropriate number of dimming levels, e.g., six dimming levels, eight dimming levels, ten dimming levels, etc.

FIG. 4 shows the dimming levels for each pixel being based on a fraction of the area of the pixel that is inside or outside of the outline. For example, the fraction of pixel 404 that is inside the outline 120 is less than the fraction of pixel 403 that is inside the outline 120. Therefore, the pixel 404, at 30% dimming, is dimmed more than the pixel 403, at 10% dimming. Similarly, the fraction of pixel 408 that is outside the outline 120 is less than the fraction of pixel 412 that is outside the outline 120. Therefore, the pixel 408, at 70% dimming, is dimmed less than the pixel 412, at 90% dimming.

In some examples, the dimming level for each pixel can be based on a proximity of the pixel to the outline. For example, pixels that overlap with the outline can have a first dimming level. Pixels that are inside of the outline and are one pixel away from the outline can have a second dimming level, pixels that are inside the outline and are two pixels away from the outline can have a third dimming level, etc. Similarly, pixels that are outside of the outline and are one pixel away from the outline can have a fourth dimming level, pixels that are outside of the outline and are two pixels away from the outline can have a fifth dimming level, etc.

Figure 5A:
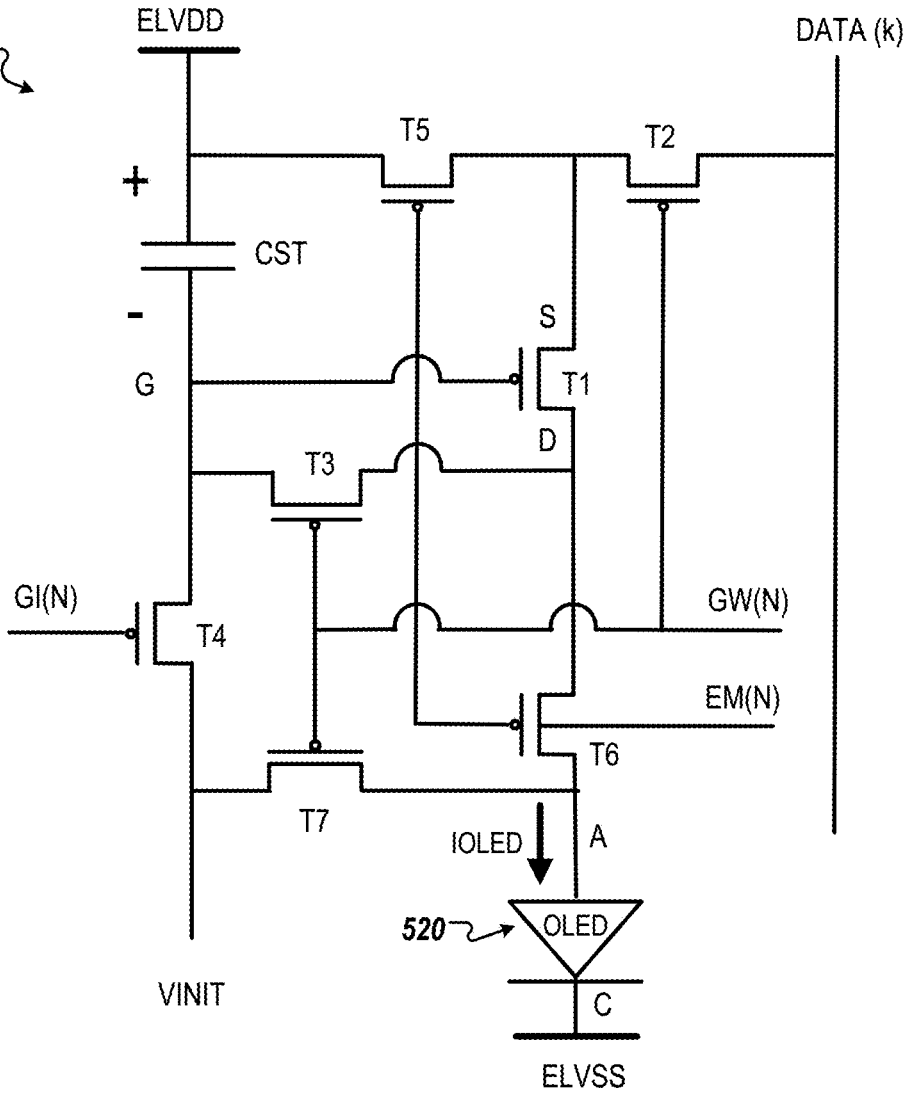
FIGS. 5A and 5B illustrate an example circuit of a pixel and a timing diagram of the pixel.
Figure 5B:
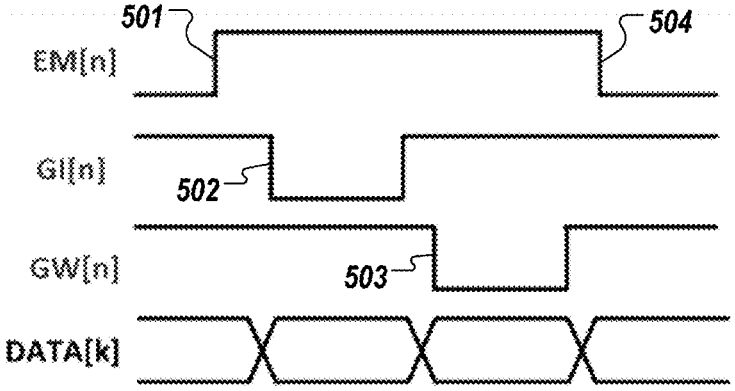

FIGS. 5A and 5B illustrate an example circuit of a full-luminance pixel and a timing diagram of the pixel. FIG. 5A is a diagram 500 of an LED and corresponding drive circuitry of a display system (referred to hereinafter at times as pixel 500 for simplicity, although diagram 500 can also represent an LED and corresponding drive circuitry for a sub-pixel). For example, FIG. 5A may illustrate a more detailed view of a pixel of the display system 200.

The pixel 500 is an active matrix OLED (AMOLED) pixel. The pixel 500 receives a scan signal "GW (N)" and a reset scan signal "GI (N)." The pixel 500 receives data voltage "DATA (k)" and an emission signal "EM (N)." The pixel 500 receives a first supply voltage ELVDD and an initial reference voltage VINIT. The pixel 500 is connected to a common ground ELVSS.

The pixel 500 includes an organic light-emitting diode (OLED) 520. The OLED 520 includes a layer of an organic compound that emits light in response to an electric current, IOLED. The organic layer is positioned between two electrodes: an anode and a cathode, such that the OLED includes an anode terminal A and a cathode terminal C. The OLED 520 is driven by a current source circuit that receives the supply voltage ELVDD. The current source circuit drives the OLED 520 to emit light.

The pixel 500 includes a storage capacitor CST, transistors T2 to T7, and an OLED-driving transistor T1. The driving transistor T1 includes a source terminal S and a drain terminal D. The drain terminal D is connected to an anode terminal A of the OLED 520 (e.g., via an intermediate transistor, such that the drain terminal D of T1 is directly connected to a source terminal of the intermediate transistor by a conductor, and a drain terminal of the intermediate transistor is directly connected to the anode terminal A of the OLED 520). The pixel 500 is programmed by the control signals: SCAN, EM, and DATA (k). The OLED current, IOLED, varies based on a voltage present across the LED-driving transistor T1.

FIG. 5B shows an example timing diagram of pixel circuit operation of the pixel 500. Voltages shown in FIG. 5B are referenced to ground. During operation, the pixel 500 undergoes an initialization stage, a programming stage, and an emission stage. During the initialization stage, the OLED 520 is turned off in preparation for programming. The OLED 520 is turned off by the EM signal switching off 501 (e.g., by being set to a high level), which turns off T5 and T6 to stop current from flowing to the OLED 520. The pixel enters an initialization stage by receiving a reset signal GI (N) 502, which turns on T4 and sets G to VINIT.

The pixel then enters a programming stage by receiving a scan signal GW (N) 503. During the programming stage, the GW (N) signal turns on, which turns on T2, T3, and T7. The voltage data DATA (k) passes through T2, T1 and T3, setting G to a value that is DATA (k) minus the threshold voltage of at least T1. Thus, when the pixel 500 receives the data voltage DATA (k) during a programming stage of a frame, this voltage is programmed to the "G" node of T1.

During the emission stage, the EM (N) signal turns on 504, which turns on T5 and T6. Current from ELVDD flows through T1 and T6 to the OLED 520, with the current level of the OLED 520 being determined by G. Thus, after the pixel 500 has changed to an emission stage of the frame, the current IOLED flows through the OLED 520 based on the voltage set at the "G" node of the driving transistor (e.g., which is based on the received data voltage DATA (k)), such that the OLED 520 emits light as electric current IOLED flows through the OLED 520. The intensity or brightness of the light depends on the amount of electrical current IOLED applied. Should a maximum current level, e.g., 100% of IOLED, flow through the OLED 520, the OLED 520 will illuminate at its "full" brightness.

A higher current generally results in brighter light. Thus, the intensity of the light emitted from the OLED 520 is based on the DATA (k) that is programmed to the "G" node, and that corresponds to image data for the individual pixel. The storage capacitor CST maintains the pixel state such that the pixel 500 remains illuminated at roughly the programmed level during the emission stage that follows the programming/addressing stage.

Figure 6:
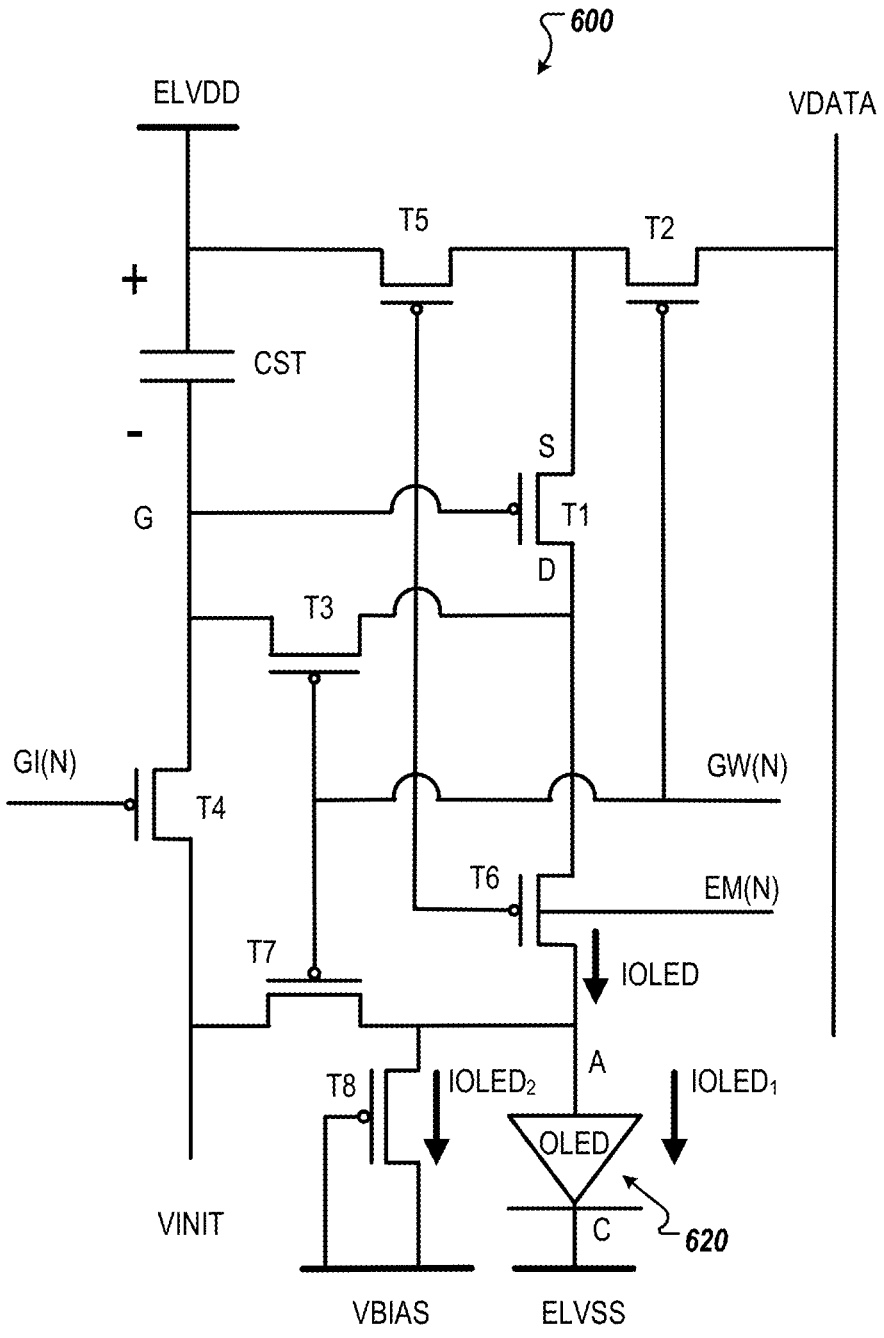
FIG. 6 illustrates an example circuit of a dimmed pixel of a rounded display corner.

FIG. 6 illustrates an example pixel circuit 600 of a dimmed pixel of a rounded display corner. The circuit 600 includes a current divider. The current divider includes a resistive element, e.g., diode-connected transistor T8. The diode-connected transistor T8 is connected to the drain terminal D of the driving transistor T1 (e.g., via an intermediate transistor T6). The current divider divides the current IOLED between the transistor T8 and the OLED 620. Thus, during emission of the OLED 620, current flows through the OLED and through the diode-connected transistor T8.

The gate electrode of the transistor T8 is electrically shorted to the drain electrode. The diode-connected transistor T8 is in parallel to the OLED diode. The gate and drain electrode are connected to bias voltage VBIAS. The OLED emission current, IOLED, from the pixel circuit is divided into IOLED1 and IOLED2. IOLED1 flows through the OLED 620, illuminating the pixel. IOLED 2 flows through the transistor T8. For a given input current IOLED, a greater amount of current flowing through the transistor T8 results in a lesser amount of current flowing through the OLED 620.

The resistance of the transistor T8 affects the amount of current IOLED2 that flows through the transistor T8, and therefore the amount of current IOLED1 that flows through the OLED 620. In an example, the resistance of the transistor T8 is equal to the resistance of the OLED, and IOLED1 is equal to IOLED2. In another example, the resistance of the transistor T8 is twice the resistance of the OLED 620, and IOLED2 is half of IOLED1. A reduction of IOLED1 from full brightness causes a dimming of the OLED 620. In some examples, the OLED can be adjusted from a high brightness of approximately five hundred nits to a low brightness of approximately ten nits.

The resistance of the transistor T8 can be controlled and/or adjusted using a number of techniques. A first technique is to control the resistance of the transistor T8 based on the design of the hardware characteristics of the transistor T8. For example, the transistor T8 can be designed to have a resistance of a specified proportion to the resistance of the OLED. The transistor T8 being connected to the drain terminal of the driving transistor T1 causes a dimming of OLED brightness in accordance with the specified proportion of the resistance. The OLED is dimmed to a default dimmed level due to the hardware characteristics of the transistor T8. The default dimmed level can be represented as a percentage dimming, compared to a full brightness OLED having the same VBIAS.

A full brightness OLED can be, for example, an OLED of a pixel in which the drain terminal of the driving transistor T1 is not connected to a source terminal of a diode-connected transistor, e.g., pixel 500. A full brightness OLED can also be an OLED of a pixel in which the drain terminal of the driving transistor T1 is connected to a source terminal of a diode-connected transistor, e.g., pixel 600, but the current divider is turned off. For example, the current divider can be turned off by setting VBIAS being set to a high value such that the full current IOLED flows through the OLED 620.

A computing device that is sending image data to a display panel can change an intensity of any given pixel by sending programming differing voltages to the G node of that respective pixel. As such, a computing device could differ the intensities of pixels as shown FIG. 4 in software. But since the image presented on the display panel may change from frame to frame, dimming pixels at the edge of a display with software involves recalculating intensity levels for such pixels each frame. For example, for each frame the computing device would initially have to identify an intended intensity of an edge pixel (e.g., 80%) and then would have to dim that pixel intensity to achieve the effect of a soft "rounded" edge to the display (e.g., dimming the 80% initial intensity value by 50% to achieve a 40% end-result intensity value to be written to the G node). These repeated computations consume energy and computing bandwidth. The technology described in this disclosure enables implementing the proportion of dimming that is due to a pixel being at a rounded edge in hardware, for example, with characteristics of the diode-connected transistor T8. As such, the computing device simply needs to program the original image data to the pixels of the display panel, and any dimming at the edges is taken care of by hardware.

Figure 7A:
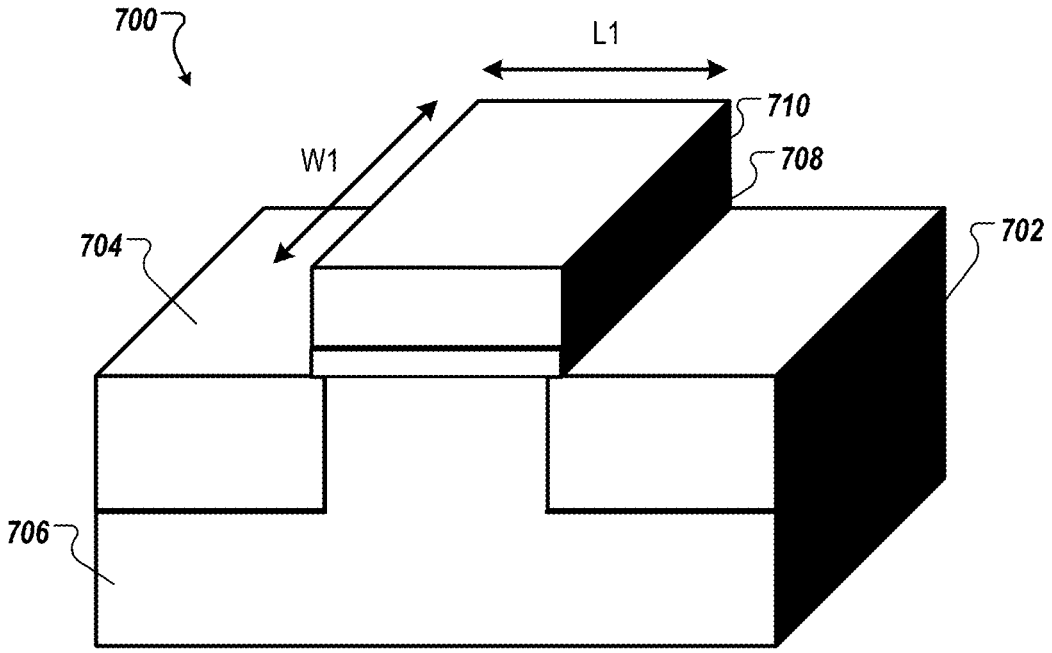
FIG. 7A and 7B illustrate example transistors of dimmed pixels of rounded display corners.
Figure 7B:
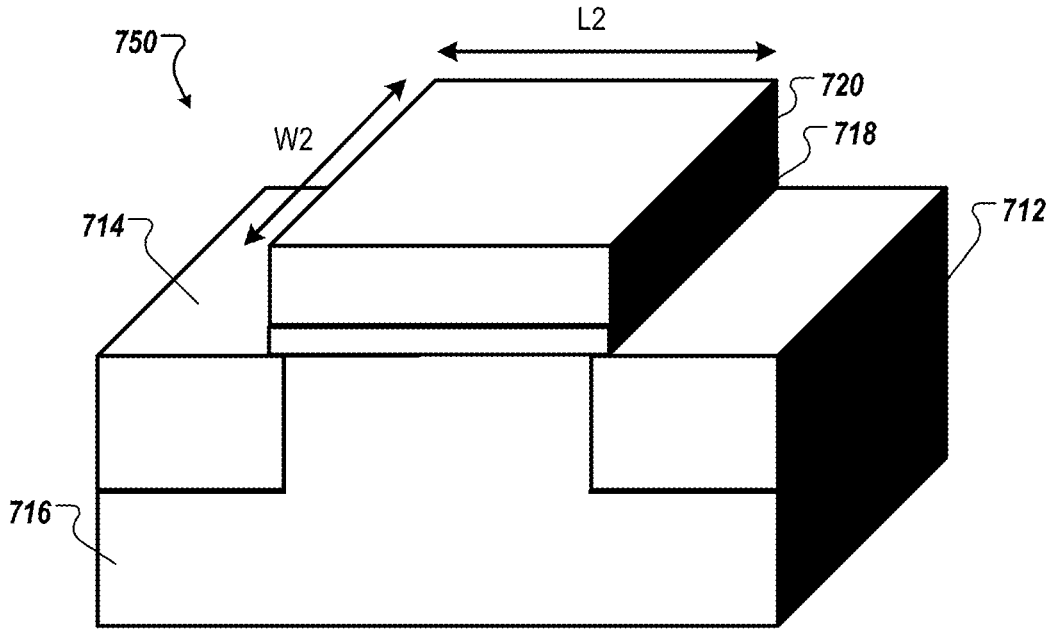

In an example, the transistor T8 can be designed to have a resistance of two-thirds of the resistance of the OLED. Hardware characteristics of the transistor T8 can include an aspect ratio of the transistor T8. The aspect ratio is a ratio of width to length ("W/L ratio") of the transistor. In some examples, the aspect ratio can be separately tuned for each pixel color. For example, the pixel circuit 600 can be a circuit of a subpixel, e.g., a red, green, or blue subpixel, of a pixel. The transistor T8 of the red subpixel may have a different aspect ratio than the aspect ratio of the green subpixel, the blue subpixel, or both. FIGS. 7A and 7B illustrate transistors with differing aspect ratios.

A second technique for controlling resistance of the transistor T8 is to adjust the bias voltage VBIAS. A higher VBIAS induces a lower IOLED2, and results in a higher emission current, IOLED1, through the OLED. Adjustments of VBIAS cause changes to the brightness of the pixel, compared to the default dimmed level. In other words, adjusting VBIAS enables a computing device to change the default dimmed level that is specified by the aspect ratio of T8 transistors.

In some examples, subpixels of a pixel can have different bias voltages. For example, the red subpixel may have a different VBIAS than the green subpixel, the blue subpixel, or both. In some examples, VBIAS can be adjusted between a high level of approximately 2V and a low value of approximately −5V. In some examples, VBIAS can be adjusted during operation of the pixel.

To adjust the dimming levels of pixels during operation, VBIAS can be adjusted based on display brightness settings. For example, the DDIC of the display system can override the dimming of the pixel 600 by increasing VBIAS. The VBIAS can be raised so that no current flows through the transistor T8. Therefore, T8 is turned off, and all of the OLED current flows through the OLED 620, so that IOLED is equal to IOLED1. In some examples, VBIAS is a global parameter. For example, adjusting VBIAS for a red subpixel may adjust VBIAS for all red subpixels of the display panel. All subpixels in a display may receive the same VBIAS, such that there may be a first VBIAS for all red subpixels, a second VBIAS for all green subpixels, and a third VBIAS for all blue subpixels.

FIGS. 7A and 7B illustrate example transistors 700, 750 of dimmed pixels of rounded display corners. Physical dimensions of a transistor can be adjusted from a default ratio to achieve a certain resistance of the transistor. The physical dimensions can include the width and length of a transistor, which affect the aspect ratio or W/L ratio of the transistor.

The transistor 700 includes drain 702, source 704, and gate 710. The transistor 700 also includes substrate 706 and oxide 708. The gate 710 has width W1 and length L1. The aspect ratio of the transistor 700 is W1/L1.

The transistor 750 includes drain 712, source 714, and gate 720. The transistor 750 also includes substrate 716 and oxide 718. The gate 720 has width W2 and length L2. The aspect ratio of the transistor 750 is W2/L2. The width W2 is the same as the width W1. The length L2 is longer than the length L1. Thus, the aspect ratio W2/L2 is less than the aspect ratio W1/L1.

Each of the transistor 700 and the transistor 750 can be used in the current divider of a dimmed pixel. For example, the transistors 700, 750 can each be used as the transistor T8 of the pixel circuit 600 (e.g., for the same-colored subpixel of two adjacent pixels at an edge of an active area of a display). The aspect ratio W2/L2 being less than the aspect ratio W1/L1 causes the transistor 750 to have a higher resistance than the transistor 700. Thus, a first pixel circuit that includes the transistor 700 as the transistor T8 has greater current flowing through the transistor T8 than an equivalent second pixel circuit that includes the transistor 750 as the transistor T8. Accordingly, the first pixel circuit that includes the transistor 700 has less current flowing through the OLED than the second pixel circuit that includes the transistor 750, and is dimmed by a greater amount. The default dimmed level of the first pixel circuit therefore is therefore dimmer, or less bright, than the default dimmed level of the second pixel circuit.

FIG. 8 is a table 800 showing changes in pixel brightness caused by changes in bias voltage and transistor width to length ratios. As discussed above, the resistance of the transistor T8 can be adjusted using two techniques. The first technique is to adjust the physical dimensions including the W/L ratio of the transistor. The second technique is to adjust the bias voltage VBIAS.

Configuration 801 of the table 800 includes an increased W/L ratio and a same VBIAS. The increased W/L ratio decreases resistance through the transistor T8, increasing IOLED2 and decreasing IOLED1. Thus, for a first pixel having a greater W/L ratio than a second pixel, and a same VBIAS as the second pixel, the first pixel will have a lower OLED brightness. For example, referring back to FIG. 4, the pixel 406 has a lower brightness (50% dimming) than the pixel 404 (30% dimming). This can be due to the pixel 406 having a current divider with a diode-connected transistor T8 that has a greater W/L ratio than the diode-connected transistor T8 of the current divider of the pixel 404.

Configuration 802 of the table 800 includes a decreased W/L ratio and a same VBIAS. The decreased W/L ratio increases resistance through the transistor T8, decreasing IOLED2 and increasing IOLED1. Thus, for a first pixel having a lower W/L ratio than a second pixel, and a same VBIAS as the second pixel, the first pixel will have a higher OLED brightness. For example, referring back to FIG. 4, the pixel 406 has a higher brightness (50% dimming) than the pixel 408 (70% dimming). This can be due to the pixel 406 having a current divider with a diode-connected transistor T8 that has a lower W/L ratio than the diode-connected transistor T8 of the current divider of the pixel 408.

Configuration 803 of the table 800 includes an increased VBIAS and a same W/L ratio. The increased VBIAS increases resistance through the transistor T8, decreasing IOLED2 and increasing IOLED1. Thus, for a first pixel having a greater VBIAS than a second pixel, and a same W/L ratio as the second pixel, the first pixel will have a higher OLED brightness.

Configuration 804 of the table 800 includes a decreased VBIAS and a same W/L ratio. The decreased VBIAS decreases resistance through the transistor T8, increasing IOLED2 and decreasing IOLED1. Thus, for a first pixel having a lower VBIAS than a second pixel, and a same W/L ratio as the second pixel, the first pixel will have lower OLED brightness.

Embodiments of the subject matter and the functional operations described in this specification can be implemented in any suitable electronic device such as a personal computer, a mobile telephone, a smart phone, a smart watch, a smart TV, a mobile audio or video player, a game console, or a combination of one or more of these devices.

The electronic device may include various components such as a memory, a processor, a display, and input/output units. The input/output units may include, for example, a transceiver which can communicate with the one or more networks to send and receive data. The display may be any suitable display including, for example, a cathode ray tube (CRT), liquid crystal display (LCD), or light emitting diode (LED) display, for displaying images.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

Embodiments may be implemented as one or more computer program products, e.g., one or more modules of computer program instructions encoded on a computer readable medium for execution by, or to control the operation of, data processing apparatus. The computer readable medium may be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus may include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) may be written in any form of programming language, including compiled or interpreted languages, and it may be deployed in any form, including as a standalone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

Processors suitable for the execution of a computer program include, by way of example, both general and special purpose microprocessors, and any one or more processors of any kind of digital computer. Generally, a processor will receive instructions and data from a read only memory or a random access memory or both.

Elements of a computer may include a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer may not have such devices. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory may be supplemented by, or incorporated in, special purpose logic circuitry.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An electronic device, comprising:

a display device that includes a plurality of pixels that form an active area of the display device, the active area of the display device defining a rounded edge portion, wherein multiple pixels that form at least part of the rounded edge portion have stepped relative brightness levels that are determined by hardware structures of the multiple pixels, such that a first pixel of the multiple pixels that is located at a first position in the rounded edge portion has a first relative brightness level defined by a first pixel hardware structure and a second pixel of the multiple pixels that is located at a second position in the rounded edge portion has a second relative brightness level defined by a second pixel hardware structure, the first relative brightness level being different from the second relative brightness level, the first pixel including:

a first light-emitting diode (LED), a first resistive element having a first adjustable resistance, and a first driving transistor configured to drive current in parallel through the first LED and the first resistive element that has the first adjustable resistance during emission of light by the first LED, wherein the display device is configured so that increasing a first bias voltage increases the first adjustable resistance of the first resistive element.

2. The electronic device of claim 1, wherein the first pixel is adjacent the second pixel in the display device.

3. The electronic device of claim 1, wherein:

the first relative brightness level comprises a first default dimmed brightness level that is dimmed with respect to a first programmed brightness level that is programmed to the first pixel; and the second relative brightness level comprises a second default dimmed brightness level that is dimmed with respect to a second programmed brightness level that is programmed to the second pixel.

4. The electronic device of claim 3, wherein:

the display device includes central pixels that form a central region of the display device that is offset from the rounded edge portion; and each central pixel of the central pixels that form the central region of the display device is structured to emit a brightness level programmed to the respective central pixel.

5. The electronic device of claim 4, wherein:

the central pixels form a contiguous block of at least one-hundred pixels offset from the rounded edge portion.

6. The electronic device of claim 1, wherein:

the first pixel comprises a first organic light-emitting diode (OLED); and the second pixel comprises a second OLED.

7. The electronic device of claim 1, wherein:

the second pixel includes:

a second LED, a second resistive element having a second adjustable resistance, and a second driving transistor configured to drive current in parallel through the second LED and the second resistive element that has the second adjustable resistance during emission of light by the second LED.

8. The electronic device of claim 7, wherein:

the first resistive element comprises a first diode-connected transistor that includes a first diode-connected transistor gate terminal and a first diode-connected transistor drain terminal that is connected to the first diode-connected transistor gate terminal; and the second resistive element comprises a second diode-connected transistor that includes a second diode-connected transistor gate terminal and a second diode-connected transistor drain terminal that is connected to the second diode-connected transistor gate terminal.

9. The electronic device of claim 8, wherein:

the first diode-connected transistor has a first resistance being in a first proportion to a resistance of the first LED;

the second diode-connected transistor has a second resistance being in a second proportion to a resistance of the second LED; and the first proportion is different from the second proportion.

10. The electronic device of claim 9, wherein:

the first diode-connected transistor has the first resistance due to the first diode-connected transistor having a first aspect ratio of physical dimensions; and the second diode-connected transistor has the second resistance due to the second diode-connected transistor having a second aspect ratio of physical dimensions; and the first aspect ratio is different from the second aspect ratio.

11. The electronic device of claim 8, wherein:

the first diode-connected transistor drain terminal is connected to the first bias voltage; and the second diode-connected transistor drain terminal is connected to the first bias voltage.

12. The electronic device of claim 7, wherein:

the display device includes:

a third pixel that includes:

a third LED, a third resistive element having a third adjustable resistance, and a third driving transistor configured to drive current in parallel through the third LED and the third resistive element that has the third adjustable resistance during emission of light by the third LED; and a fourth pixel that includes:

a fourth LED, a fourth resistive element having a fourth adjustable resistance, and a fourth driving transistor configured to drive current in parallel through the fourth LED and the fourth resistive element that has the fourth adjustable resistance during emission of light by the fourth LED;

the third pixel is a sub-pixel of a first composite pixel;

the fourth pixel is a sub-pixel of a second composite pixel;

the third LED of the third pixel emits a same color as the fourth LED of the fourth pixel, such that the third pixel and the fourth pixel represent same-colored subpixels; and the color emitted by the first pixel and the second pixel is different from the color emitted by the third pixel and the fourth pixel.

13. The electronic device of claim 12, wherein:

the third resistive element comprises a third diode-connected transistor that includes a third diode-connected transistor gate terminal and a third diode-connected transistor drain terminal that is connected to the third diode-connected transistor gate terminal and to a second bias voltage;

the fourth resistive element comprises a fourth diode-connected transistor that includes a fourth diode-connected transistor gate terminal and a fourth diode-connected transistor drain terminal that is connected to the fourth diode-connected transistor gate terminal and to the second bias voltage; and the second bias voltage is different from the first bias voltage.

14. The electronic device of claim 1, wherein:

the display device includes central pixels that form a central region of the display device that is offset from the rounded edge portion; and each central pixel of the central pixels that form the central region of the display device includes a corresponding central pixel LED and corresponding central pixel driving transistor that is configured to drive current through the corresponding central pixel LED without driving current through a corresponding resistive element in parallel with the corresponding central pixel LED.

15. The electronic device of claim 1, wherein:

the first pixel is a sub-pixel of a first composite pixel in the display device;

the second pixel is a sub-pixel of a second composite pixel in the display device; and the first LED of the first pixel emits a same color as a second LED of the second pixel, such that the first pixel and the second pixel represent same-colored subpixels.

16. The electronic device of claim 1, wherein:

the first resistive element comprises a first diode-connected transistor that includes a first diode-connected transistor gate terminal and a first diode-connected transistor drain terminal that is connected to the first diode-connected transistor gate terminal; and the display device is configured so that increasing the first bias voltage increases the first adjustable resistance of the first diode-connected transistor.

17. The electronic device of claim 1, wherein:

the first driving transistor is connected to the first LED via a first intermediate transistor in series between the first driving transistor and the first LED.

* * * * *